United States Patent [19]

Schucker

[11] 4,414,099

[45] Nov. 8, 1983

[54] FLUID COKING WITH THE ADDITION OF ALKALINE EARTH METAL FERRITE-CONTAINING CATALYSTS

[75] Inventor: Robert C. Schucker, Baton Rouge, La.

[73] Assignee: Exxon Research and Engineering Co., Florham Park, N.J.

[21] Appl. No.: 416,908

[22] Filed: Sep. 13, 1982

[51] Int. Cl.[3] ..... C10G 11/18; C10G 51/04

[52] U.S. Cl. ..... 208/121; 208/127; 208/124

[58] Field of Search ..... 208/120, 124, 127, 121

[56] References Cited

U.S. PATENT DOCUMENTS

| | | | |
|---|---|---|---|
| 3,707,462 | 1/1971 | Moss | 208/127 |
| 4,229,283 | 10/1980 | Sosnowski | 208/127 |
| 4,269,696 | 5/1981 | Metrailer | 208/120 |
| 4,298,460 | 11/1981 | Fujimori et al. | 208/124 |
| 4,305,809 | 12/1981 | Chen et al. | 208/127 |
| 4,308,173 | 12/1981 | Fujimori et al. | 208/124 |

*Primary Examiner*—Delbert E. Gantz
*Assistant Examiner*—Anthony McFarlane
*Attorney, Agent, or Firm*—Marthe L. Gibbons

[57] ABSTRACT

A fluid coking process is provided in which a catalyst comprising an alkaline earth metal ferrite is present in the fluid coking zone.

12 Claims, 2 Drawing Figures

FLUID COKING WITH THE ADDITION OF ALKALINE EARTH METAL FERRITE-CONTAINING CATALYSTS

BACKGROUND OF THE INVENTION

1. Field of the Invention

This invention relates to an improvement in a fluid coking process. More particularly, this invention relates to a fluid coking process conducted in the presence of an alkaline earth metal ferrite-containing catalyst.

2. Description of the Prior Art

Fluid coking is a well-known process which may be carried out with or without recycle of the heavier portion of the fluid coking zone effluent. As is well known in the art, the fluid coking process, as shown for example, in U.S. Pat. No. 2,881,130, which is hereby incorporated by reference, uses a fluid coking vessel and an external heating vessel. A fluid bed of solids, preferably coke particles produced by the process having a size in the range from about 40 to about 1000 microns is maintained in the coking zone by upward passage of fluidizing gas, usually steam, injected at a superficial velocity usually between 0.3 and 5 feet per second. The temperature in the fluid coking bed is maintained in the range of about 850° to about 1400° F., preferably between 900° and 1200° F. by circulating solids (coke) to the heating vessel and back. The heavy oil to be converted is injected into the fluid bed and upon contact with the hot solids undergoes pyrolysis evolving lighter hydrocarbon products in vapor phase, including normally liquid hydrocarbons, and depositing a carbonaceous residue (coke) on the solids. The turbulence of the fluid bed normally results in substantially isothermal reaction conditions and thorough and rapid distribution of the heavy injected oil. The feed rate and temperature are controlled to maintain the bed in a fluidized state. Product vapors, after removal of entrained solids, are withdrawn overhead from the coking zone and sent to a scrubber and fractionator for cooling and separation. The end boiling point of distillate fractions obtained from the process is usually about 1050° F. to about 1200° F. and the remaining heavy ends are usually recycled to extinction.

U.S. Pat. No. 4,269,696 discloses an integrated fluid coking and gasification process in which a solid cracking catalyst is added to the coker chargestock.

U.S. Pat. No. 3,707,462 discloses a fluid coking process in which calcium oxide or a precursor thereof is present in the fluidized bed coking zone.

U.S. Pat. No. 4,229,283 discloses fluid hydrocoking with the addition of dispersible metal compounds in the coker feed. Metallic ashes recovered from the gasification of the coke are recycled to the coker feed.

It has now been found that the presence of an alkaline earth metal ferrite-containing catalyst in the fluid coking zone will permit conducting the fluid coking reaction at a lower temperature at a constant feed rate or will permit an increase in feed rate at a constant temperature.

SUMMARY OF THE INVENTION

In accordance with the invention there is provided, in a fluid coking process comprising the steps of: contacting a carbonaceous chargestock with hot fluidized coking bed contained in a fluid coking zone maintained in a fluidized state by the introduction of a fluidizing gas and operated at coking conditions, to produce a vapor phase product and a solid carbonaceous material which deposits on said fluidized solids, the improvement which comprises the presence of a catalyst in said coking zone, said catalyst comprising an effective amount of at least one alkaline earth metal ferrite.

The term "ferrite" is used herein in accordance with the definition given in Hackh's Chemical Dictionary, third Edition, McGraw Hill, N.Y., 1944, namely, an unstable compound of ferric oxide with a strong base, which exists in strongly alkaline solutions of iron.

DESCRIPTION OF THE PREFERRED EMBODIMENT

Figure 1:
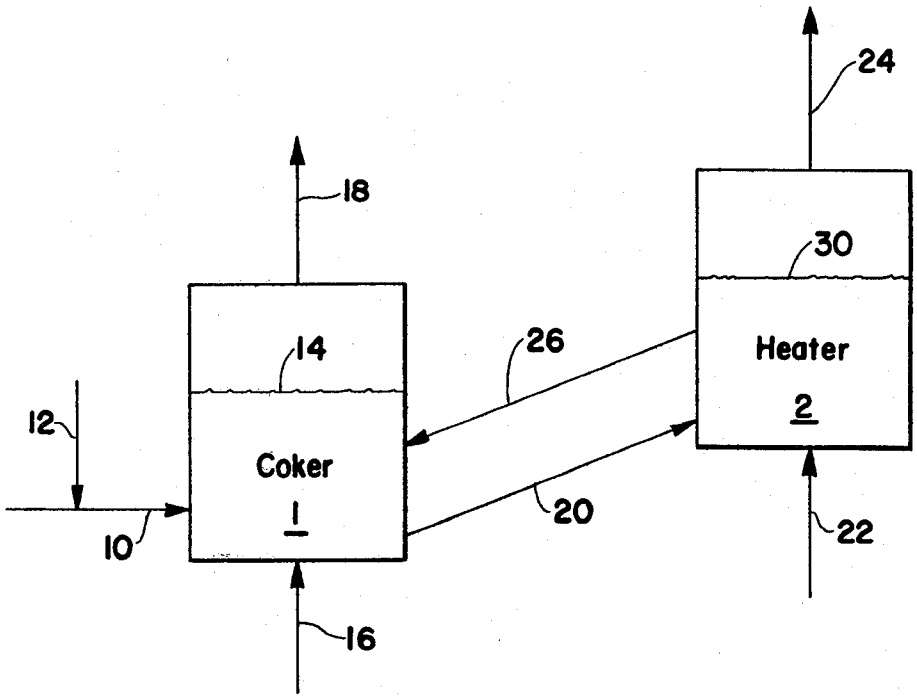
FIG. 1 is a schematic flow plan of one embodiment of the invention.

Referring to FIG. 1, a carbonaceous charge-stock having a Conradson carbon content of about 15 weight percent such as heavy residuum having an atmospheric pressure boiling point of about 1050° F.+, is passed by line 10 into a coking zone 1 in which is maintained a fluidized bed solids (e.g. coke particles of 40 to 1000 microns in size) having an upper level indicated at 14. The fluidized bed of solids in the coking zone comprises a catalyst comprising at least one alkaline earth metal ferrite. The alkaline earth metal component is selected from the group consisting of beryllium, magnesium, calcium, strontium, barium and mixtures thereof. Preferably, the alkaline earth metal ferrite is selected from the group consisting of calcium metaferrite ($CaOFe_2O_3$); calcium orthoferrite ($2\ CaOFe_2O_3$); magnesioferrite ($MgOFe_2O_3$); barium ferrite ($BaFe_{12}O_{19}$); and mixtures thereof. More preferably, the alkaline earth metal ferrite is barium ferrite ($BaFe_{12}O_{19}$). The alkaline earth metal ferrite may be a single alkaline earth metal ferrite or a mixture of alkaline earth metal ferrites. The alkaline earth metal ferrite may be present in the catalyst in an amount ranging from about 0.1 to 100 weight percent. Thus, the catalyst may be an unsupported alkaline earth metal ferrite, that is, 100% alkaline earth metal ferrite or the alkaline earth metal ferrite may be a component in a composite catalyst. The composite catalyst may include supports which may be chosen from a wide variety of conventional supports, such as, silica, alumina, silica-alumina, silica-zirconia, other inorganic oxides, carbon, etc. The catalyst is suitably present in the fluid coking zone in an amount such as to provide a weight ratio of catalyst to carbonaceous feed ranging from about 0.1:1 to 1:1.

Suitable carbonaceous chargestocks for the fluid coking stage of the present invention include heavy hydrocarbonaceous oils; heavy and reduced petroleum crudes; petroleum atmospheric distillation bottoms; petroleum vacuum distillation bottoms; pitch; asphalt; bitumen; other heavy hydrocarbon residues; tarsand oil; shale oil; liquid products derived from coal liquefaction processes, including coal liquefaction bottoms; coal; coal slurries, and mixtures thereof. Typically such feeds have a Conradson carbon residue of at least 5 weight percent, generally from about 5 to about 50 weight percent, preferably above about 7 weight percent (as to Conradson carbon residue, see ASTM Test D 189-65), and a high content of metal contaminants.

In the preferred embodiment, the ferrite-containing catalyst is added to the carbonaceous chargestock by line 12, although the catalyst may be introduced directly into the coking zone or indirectly into the coking zone via solids or fines that are recycled to the coker. Returning to line 12, the catalyst is added to the chargstock in an amount ranging from 0.1 to about 10 weight percent, preferably from about 1 to about 10 weight percent based on the initial coker chargestock, although the equilibrium level of catalyst in the coker may be higher than 10 weight percent based on carbonaceous feed. The added catalyst particles are suitable below about 44 microns in diameter, preferably below about 20 microns in diameter, more preferably below about 5 microns in diameter.

A fluidizing gas is admitted to coker 1 by line 16 in an amount sufficient to maintain a superficial gas velocity in the range of about 0.3 to about 5 feet per second. The fluidizing gas may comprise steam, gaseous hydrocarbons, vaporized normally liquid hydrocarbons, hydrogen, hydrogen sulfide, and mixtures thereof. Typically, the fluidizing gas used will comprise steam. Coke at a temperature above the coking temperature, for example, at a temperature of 100 to 800 Fahrenheit degrees in excess of the actual operating temperature of the coking zone is admitted to coker 1 by line 26 in an amount sufficient to maintain the coking temperature in the range of about 850° to about 1400° F., preferably in the range of about 900° to about 1200° F. The total pressure in the coking zone is maintained in the range of about 0 to about 150 pounds per square inch gauge (psig), preferably in the range of about 5 to about 100 psig. The lower portion of the coker serves as a stripping zone to remove occluded hydrocarbons from the solids. The vaporous products include gaseous hydrocarbons and normally liquid hydrocarbons as well as other gases which were introduced into the coker as fluidizing gas. The vapor phase product is removed from coker 1 by line 18 for scrubbing and fractionation in a conventional way. If desired, at least a portion of the vaporous effluent may be recycled to the coker as fluidizing gas. A stream of heavy material condensed from the vaporous coker effluent may be recycled to the coker or the coker may be operated in a once-through manner, that is, without recycle of the heavy material to the coker.

A stream of stripped coke (commonly called cold coke) is withdrawn from the coker by line 20 and introduced into a fluid bed of hot coke having a level 30 in heater 2. The heater may be operated as a conventional coke burner such as disclosed in U.S. Pat. No. 2,881,130, which is hereby incorporated by reference. When the heater is operated as a burner, an oxygen-containing gas, typically air, is introduced into heater 2 by line 22. The combustion of a portion of the solid carbonaceous deposition on the solids with the oxygen-containing gas provides the heat required to heat the colder particles. The temperature in the heating zone (burning zone) is maintained in the range of about 1200° to about 1700° F. Alternatively, heater 2 can be operated as a heat exchange zone such as disclosed in U.S. Pat. Nos. 3,661,543; 3,702,516 and 3,759,676, the teachings of which are hereby incorporated by reference. Hot coke is removed from the fluidized bed in heater 2 and recycled to the coker by line 26 to supply heat thereto. If desired, the catalyst may be recovered from the heating zone or from the gasification zone of an integrated coking and gasification process and the recovered catalyst may be recycled to the coker chargestock or to the dilute phase of the coker, as described in U.S. Pat. No. 4,269,696, the teachings of which are hereby incorporated by reference.

The following examples are presented to illustrate the invention.

EXAMPLE 1

Figure 2:
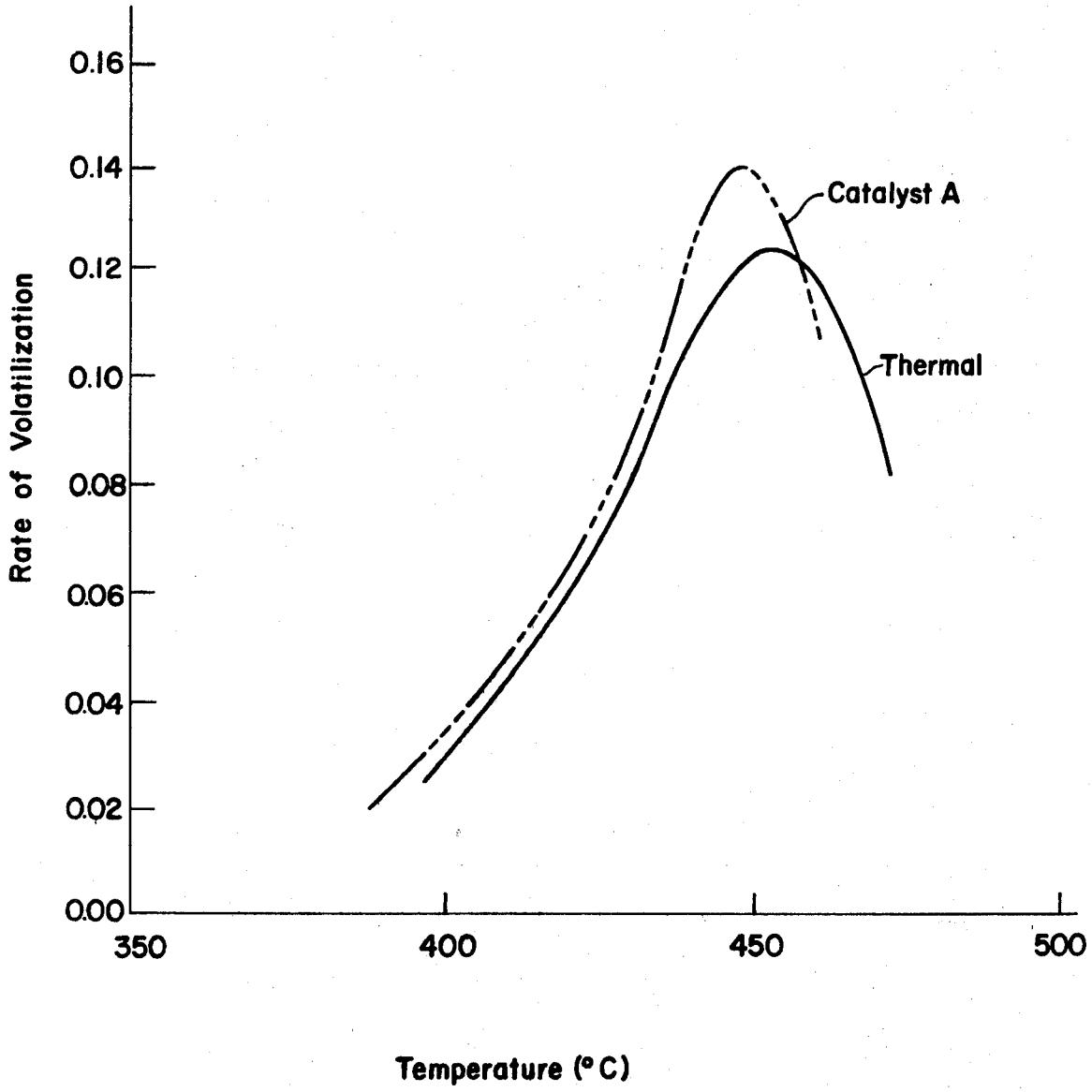
FIG. 2 is a graph showing rate of volatilization of a vacuum residuum versus temperature for a barium ferrite catalyst.

Comparative experiments were made with an Arabian heavy vacuum residuum feed having an atmospheric pressure initial boiling point of about 1050° F. and a Conradson carbon content of about 26.8 weight percent. One experiment, herein designated experiment A, was made utilizing catalyst A which was essentially barium ferrite ($BaFe_{12}O_{19}$). One experiment, herein designated experiment B, was made without any catalyst (thermal run). To simulate the reactions which occur in the dense bed of the coker, a portion of approximately 20 mg of the above-described vacuum residuum was placed in a quartz dish with approximately 20 mg of catalyst A. The feed and catalyst A were then suspended from a microbalance and heated to 525° C. under flowing helium. Weight loss as well as rate of weight loss were measured as a function of temperature. The rate of volatilization was used as an indication of catalytic activity. The same feed and conditions without the addition of a catalyst were used for experiment B. The results of these experiments are summarized in FIG. 2. As can be seen from FIG. 2, experiment A, which was run in accordance with the present invention utilizing catalyst A, gave a higher rate of volatilization at a lower temperature than experiment B which was a thermal experiment.

EXAMPLE 2

To determine the activity of Catalyst A, $BaFe_{12}O_{19}$, in tests simulating the reactions which occur in the dilute phase of a fluid coker, comparative runs were made using a coker gas oil feed having a boiling point greater than 650° F., an API gravity at 60° F. of 15.9 and a Conradson carbon content of 6.5. Duplicate fluid bed experiments were carried out at 510° C. (950° F.) using 20 grams of catalyst A (barium ferrite) and 14.8 grams of feed pumped in at the rate of about 3 grams per minute. The catalyst was fluidized by vaporized feed and steam (steam/feed ratio=0.15). Results from these runs, herein designated Runs C and D, are summarized in Table I. The same feed and same conditions were used in a second pair of experiments, herein designated Runs E and F, in which are inert solid, alpha alumina, herein designated Solid E, was used instead of Catalyst A. As can be seen from Table I, Runs C and D, which were run in accordance with the present invention, produced a substantial shift in the boiling range of the liquid products to lower temperature while maintaining constant product yields. Both the $C_5$/430° F. naphtha and the 430° F./650° F. gas oil have been increased by Catalyst A at the expense of 650° F.+ products relative to the run utilizing Solid E.

TABLE I

| Solids | Run No. C | Catalyst A | D | E | Solid E | F |
|---|---|---|---|---|---|---|
| Product Yields, Wt. % | | | | | | |
| $C_4$− gas | 2.1 | | 2.0 | 1.5 | | 2.1 |
| $C_5$+ liquids | 93.0 | | 93.3 | 92.2 | | 93.9 |
| Coke | 4.9 | | 3.8 | 3.0 | | 3.0 |
| | 100.0 | | 99.1 | 96.7 | | 99.0 |
| Liquid Quality | | | | | | |
| $C_5$/430° F. | 14.37 | (15.60) | 16.82 | 10.68 | (11.31) | 11.94 |
| 430/650° F. | 37.59 | (27.38) | 27.16 | 25.35 | (25.58) | 25.81 |
| 650/950° F. | 40.74 | (39.93) | 39.12 | 43.72 | (43.61) | 43.50 |
| 950/1050° F. | 12.16 | (12.00) | 11.83 | 14.40 | (14.13) | 13.85 |
| 1050° F. | 5.14 | (5.11) | 5.07 | 5.85 | (5.38) | 4.90 |
| | 100.00 | (100.02) | 100.00 | 100.00 | (100.00) | 100.00 |

The numbers in parentheses in TABLE I are arithmetic averages of the two runs.

What is claimed is:

1. In a fluid coking process comprising the steps of: contacting a carbonaceous chargestock with hot fluidized solids in a fluidized coking bed contained in a coking zone maintained in a fluidized state by the introduction of a fluidizing gas and operated at coking conditions, to produce a vapor phase product and a solid carbonaceous material which deposits on said fluidized solids, the improvement which comprises the presence of a catalyst in said coking zone, said catalyst comprising an effective amount of at least one alkaline earth metal ferrite.

2. The process of claim 1 wherein said alkaline earth metal is selected from the group consisting of beryllium, magnesium, calcium, strontium, barium and mixtures thereof.

3. The process of claim 1 wherein said alkaline earth metal ferrite is selected from the group consisting of calcium metaferrite, calcium orthoferrite, magnesioferrite, barium ferrite, and mixtures thereof.

4. The process of claim 1 wherein said alkaline earth metal ferrite is barium ferrite.

5. The process of claim 1 wherein said catalyst is present in said coking zone in a weight ratio of catalyst to carbonaceous feed ranging from about 0.1:1 to about 1:1.

6. The process of claim 1 wherein said catalyst is added to said chargestock in an amount ranging from about 0.1 to about 10 weight percent based on said chargestock.

7. The process of claim 1 wherein said alkaline earth metal ferrite is present in said catalyst in an amount ranging from about 0.1 to 100 weight percent.

8. The process of claim 1 wherein said catalyst has a particle size of less than about 44 microns in diameter.

9. The process of claim 1 wherein said coking conditions include a temperature ranging from about 850° to about 1400° F.

10. The process of claim 1 wherein said coking conditions include a temperature ranging from about 900° to about 1200° F.

11. The process of claim 1 wherein said coking conditions include a pressure ranging from about 0 to about 150 psig.

12. The process of claim 1 wherein said catalyst consists essentially of an alkaline earth metal ferrite.

* * * * *